United States Patent [19]

Kenny

[11] Patent Number: 4,787,315

[45] Date of Patent: Nov. 29, 1988

[54] APPARATUS FOR SEVERING TUBULAR MEMBERS

[76] Inventor: John J. Kenny, 500 Wall Blvd., Apt. 239, Gretna, La. 70056

[21] Appl. No.: 91,102

[22] Filed: Aug. 31, 1987

[51] Int. Cl.[4] ..... F42B 3/00

[52] U.S. Cl. ..... 102/313; 102/312; 299/13

[58] Field of Search ..... 102/312, 313; 299/13

[56] References Cited

U.S. PATENT DOCUMENTS 3,654,866 4/1972 Fritz ..... 102/23
4,354,433 10/1982 Owen ..... 102/320 X
4,357,873 11/1982 Jager ..... 102/320 X
4,669,540 6/1987 Luoma et al. ..... 102/333 X
4,694,754 9/1987 Dines et al. ..... 102/333 X

*Primary Examiner*—Peter A. Nelson
*Attorney, Agent, or Firm*—Keaty & Keaty

[57] ABSTRACT

The invention relates to an apparatus for explosively severing tubular members at a pre-designated severance level. The apparatus is designed to deliver a detonation signal to a ring-shaped explosive charge, to an annularly formed detonation signal receiving locations, so that explosion takes place substantially simultaneously about the circumference of the explosive charge about internal periphery of the tubular member at the severance level.

19 Claims, 2 Drawing Sheets

APPARATUS FOR SEVERING TUBULAR MEMBERS

BACKGROUND OF THE INVENTION

Field of the Invention

The present invention relates to an apparatus for explosively severing tubular members and more specifically to an apparatus for severing tubular members below a body of waer, such as, for example, an offshore rig platform pile.

During offshore drilling and production operations, it is sometimes necessary to move a platform to a different location, retrieving as much of the equipment as possible. An offshore platform is usually supported by a number of piles which extend from the platform downwardly through the body of water and below a mudline. It is usually there, below the mudline, that the piles have to be severed in order to the platform to be transported to a new, preselected location.

At present, the most commonly used explosive severing method utilizes a bulk explosive which is delivered to a level below the mudline through the interior of the pile, where it is detonated to produce an explosive charge. The results of such explosion are extremely unsatisfactory, since the unfocused charge not only creates signficant shock waves which create hazardous conditions for sea life, but the bottom of the so severed pile becomes flared, which makes it difficult for operators to remove the severed portion through the jacket which surrounds the pile circumferentially.

The currently used bulk explosive methods utilize approximately 60 lbs. of explosive or 1 lb. per diametric inch of the pile plus 10% or 15% of additional explosive.

Other devices and methods utilized to severe piles below the mudline include the use of a 2 point explosive, wherein a circular body carries a pair of diametrically positioned explosive units for detonating them at a point where the severing of the pile is desired.

The use of such an explosive also creates problems, one of the problems being a noncomplete severance of the pile or significant shock waves, which consequently effects the sealife.

There are also a number of methods which utilize ring-shaped explosive charges wherein the detonation is initiated at one point of the circle, allowing the detonation to spread out through the circle in a sporadic manner.

None of the above-noted devices can be utilized to create a focused charge which will accomplish severing of the pipe in the beneficial manner afforded by the present invention. It is therefore an object of the present invention to provide an apparatus wherein detonation is accomplished to create a focused charge, so that the pile or a tubular member is severed at an exact chosen location, without creating flare to the pile or unnecessary excessive shock waves affecting the sealife.

It is a further object of the present invention to provide an apparatus for creating a focused, uniform explosion for severing tubular objects wherein the detonation occurs at a plurality of points substantially simultaneously adjacent to the inner periphery of the tubular member being severed.

SUMMARY OF THE INVENTION

This and other objects which will be apparent to those skilled in the art are achieved by the present invention and the problems of the prior art are solved in a simple and straight-forward manner. The apparatus for severing tubular members comprises a frame with a pair of spaced-apart circular deflection plates held in parallel relationship to each other by a plurality of bolts, the apparatus also comprising a sleeve portion having a smaller diameter than the deflection plates and positioned perpendicularly to the deflection plates. A ring-shaped explosive is wrapped around the sleeve, on the outside thereof, with a plurality of detonating points equidistantly, circumferentially positioned in electrical communication with the detonation charge control means.

A pair of compression plates are attached in parallel to the deflection plates to insure a stable position of the deflection plates in relation to the explosive during detonation.

A stabilizing positioning assembly is attached to the bottom compression plate to insure proper alignment of the apparatus when it is being lowered into the pile. A central conduit passing through the top compression and deflection plates serves to house an electrical cable or transfer explosive for delivering an initiation means to the explosive for detonating it at a plurality of detonation points, thus insuring a substantially simultaneous detonation of the explosive around the inner periphery of the charge.

A second embodiment provides for the use of a ring shaped explosive "sandwiched" between a pair of deflection plates, with the radially extending explosive conduit communicating with the central conduit for delivering the electrical current or transfer explosive substantially simultaneously throughout the inner periphery of the explosive charge. A plurality of centralizers are mounted on the bottom and upper compression plates to allow for aligned lowering and positioning of the severing apparatus into the pile to a predetermined location below the mudline.

Other objects and purposes of the invention will be clear from the following detailed description of the drawings.

DESCRIPTION OF THE PREFERRED EMBODIMENT

Figure 1:
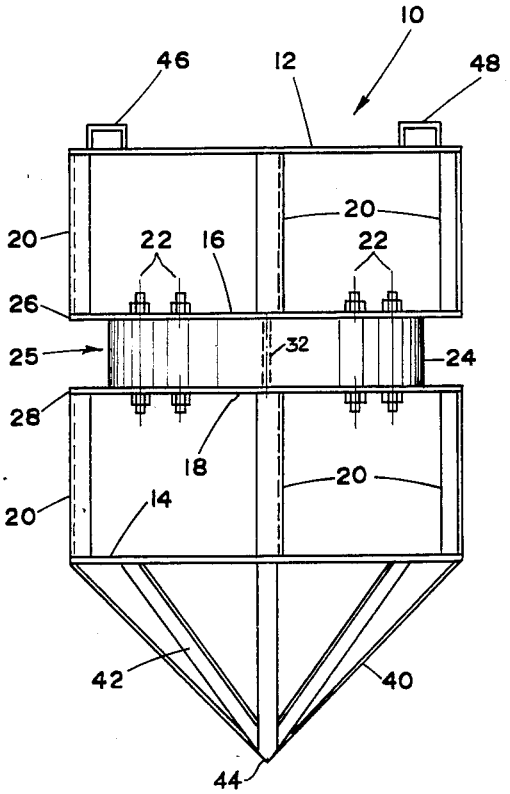
FIG. 1 is an elevational side view of the first embodiment of the apparatus in accordance with the present invention.
Figure 2:
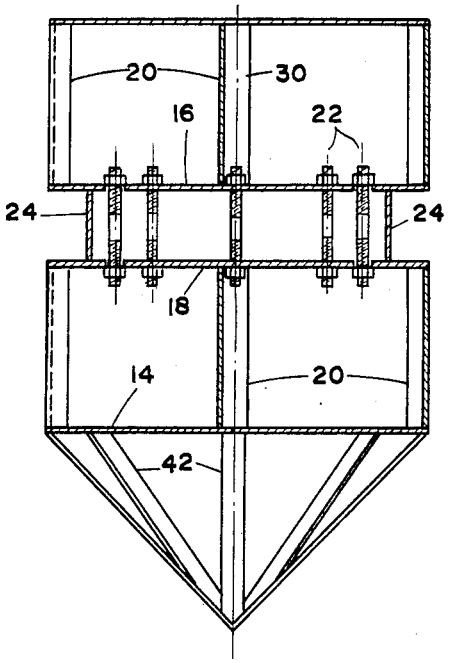
FIG. 2 is a cross-sectional view of the embodiment shown in FIG. 1.
Figure 3:
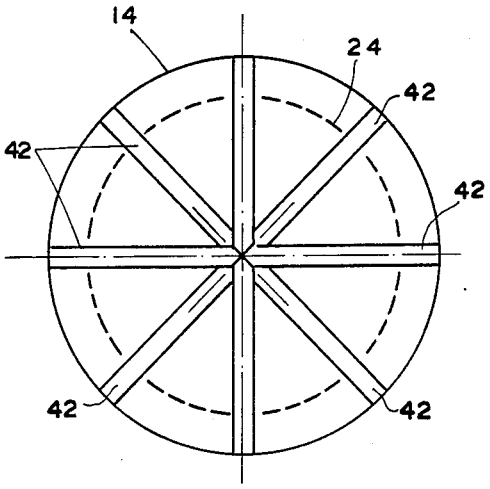
FIG. 3 is a bottom view of the embodiment shown in FIGS. 1 and 2.
Figure 4:
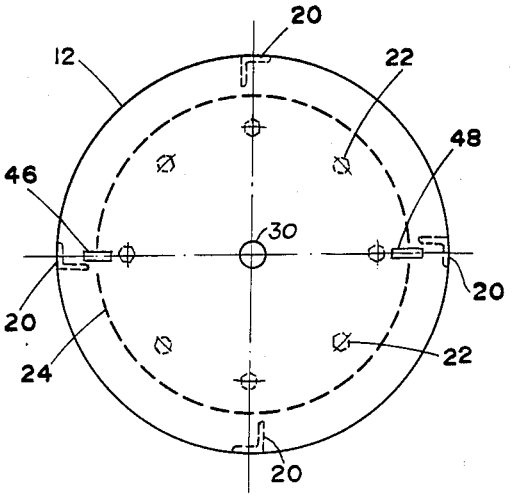
FIG. 4 is a top view of the embodiment shown in FIGS. 1–3.

Reference is now being made to FIGS. 1–4 which illustrate the first embodiment of the apparatus of the present invention. In this embodiment, the apparatus of the present invention is designated by numeral 10. The severing apparatus comprises a frame, comprised of a top compression plate 12, a parallel bottom compression plate 14, each being attached in parallel relationship to its corresponding deflection plate 16 and 18, respectively, through the use of spacer bars 20 fixedly attached substantially equidistantly at the peripheral edges of plates 12, 16 and 14, 18. The deflection plates 16, 18 and compression plates 12, 14 are circular in shape, having substantially identical diameters with the distances between the upper compression plate 12 and upper deflection plate 16 being substantially equal to the distance between the lower deflection plate 18 and the lower compression plate 14. The compression plate 12, spaced from the deflection plate 16 through the use of spacer elements 20 form the top portion of the apparatus, while the lower deflection plate 18 and the lower compression plate 14 spaced apart with the help of spacer elements 20 form the middle portion of the apparatus of the present invention. The top portion and the middle portion are secured in a fixed, spaced relationship through the use of securing bolts 22 equidistantly spaced about a circumference of a diameter smaller than the total diameter of the plates 12, 14, 16 or 18.

An annular sleeve 24 is positioned between the outer periphery of the deflection plates 16 and 18 and securing bolts 22, so that an annular space is provided between the sleeve 24 and the outer edges 26 and 28 of the deflection plate 16 and 18. The sleeve 24 is affixed perpendicularly to the deflection plates 16 and 18, in parallel to the securing bolts 22. A plastic explosive (not shown) is subsequently wrapped around the sleeve 24, on the exterior thereof, in the annular space 25 between the sleeve 24 and the outer edges 26 and 28 of deflection plates 16 and 18.

A central conduit 30 houses an electrical cable 32 which is connected in the usual manner, herein not shown, to an electrical detonation control unit positioned on the surface. Electrical current delivered through the cable 32 is supplied to a plurality of equidistantly spaced points throughout the circumference of the explosive wrapped about the sleeve 24, so that when the charge is detonated at the surface, the explosion will take place substantially simultaneously throughout the circumference of the explosive charge.

The bottom portion of apparatus 10 is designated by numeral 40 in the drawings and has a generally conical shape, with the apex 44 of the cone facing downwardly, and with the base of the cone being formed by a bottom surface of the compression plate 14. The conical portion 40 is formed by a plurality of elongated bars 42 radiating from the apex 44 of the conical portion 40 and extending to the periphery of the compression plate 14.

The conical portion 44 allows an easy alignment of the apparatus 10 when it is being lowered into the opening of a platform pile and adds structural support to the middle portion of the apparatus. The apparatus can be suspended through the use of conventional suspension means (not shown) attached to a pair of pad-eyes 46 and 48 affixed to the top surface of compression plate 12.

It should be noted that the diameter of the plates 12, 14, 16 and 18 could be varied in accordance with the diameter of the pile to be severed, the only requirement being that the diameter of the plates 12, 14, 16 and 18 be at least slightly smaller than the diameter of the central opening within the pile. Likewise, the diameter of the sleeve 24 can be varied depending on the amount of explosive to be utilizied at a particular cutting job, so that greater or less annular space 25 is left between the edges 26, 28 of the deflection plates 16 and 18 to the exterior of the sleeve 24.

Figure 5:
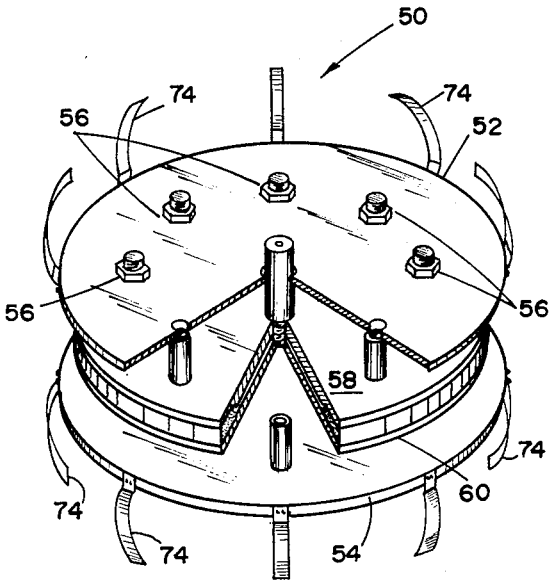
FIG. 5 is an elevational view of a second embodiment of the present invention.
Figure 6:
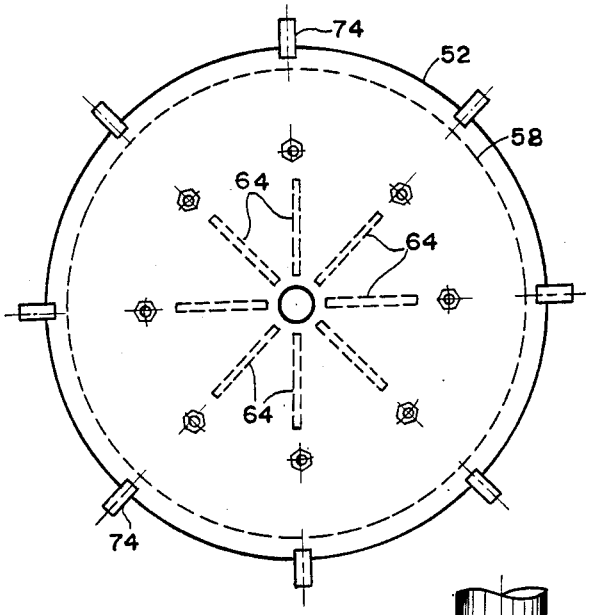
FIG. 6 is a top view of the apparatus of FIG. 5.
Figure 7:
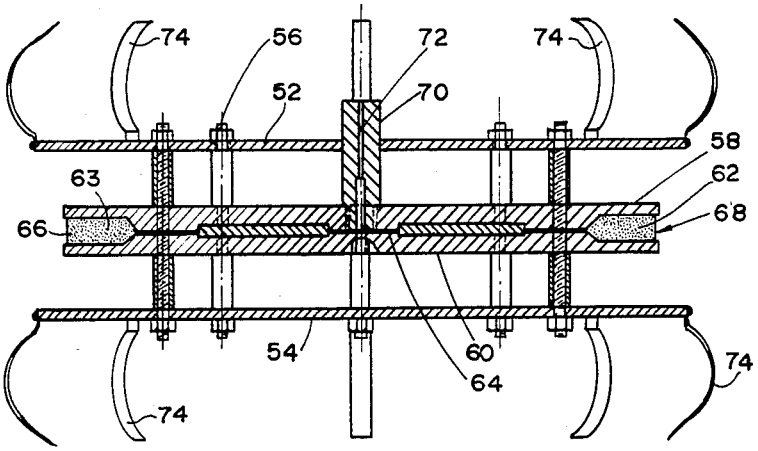
FIG. 7 is a cross-sectional view of the apparatus shown in FIGS. 5 and 6.

Reference will now be made to the embodiment shown in Figs. 5–7, wherein numeral 50 designates the second emboidment of the apparatus in accordance with the present invention. Similar to the embodiment shown in FIGS. 1–4, the explosive cutting device 50 comprises a frame having a pair of parallel compression plates 52 and 54 connected to each other by a plurality of spaced-apart, peripherally mounted securing bolts 56 which extend through correspondingly aligned openings made in the compression plates 52 and 54. A pair of parallel deflection plates 58 and 60 are mounted between the compression plates 52 and 54 in parallel relationship thereto, so that the bolts 56 extend through the plates 58 and 60 through similarly co-aligned openings. The deflection plates 58 and 60 have a slightly smaller diameter than that of compression plates 52, 54. An explosive charge 62 is "sandwiched" between complementary mating surfaces of the deflection plates 58 and 60, first in explosive transfer channel 64.

The explosive transfer channel 64 is formed by complementary lower surface of the upper deflection plate 58 and upper surface of the lower deflection plate 60. The explosive transfer channel 64 is created by a plurality of spacers 65 which are filled in grooves in the lower surface of the upper deflection plate 58 and the upper surface of the lower deflection plate 60. The explosive transfer channel 64 communicates with an annular space 63 formed at the peripheries of the deflection plates 58 and 60, so that the main explosive charge 66 annularly encompasses the periphery of the deflection plates 58 and 60. To prevent the explosive charge 66 from releasing from the confines of the channel 64, a holding member 68 is provided adjacent the outer edges of the plates 58 and 60. The holding member 68 is attached perpendicularly to the deflection plates 58 and 60, closing the annular space 63 on the exterior thereof.

A central conduit 70 serves to house an electrical cable, or detonating cord or other suitable initiating means 72 which is designed to deliver detonating signal to the explosive charge 62. An explosive transfer channel 64 facilitates delivery of the detonating signal to a plurality of radially equidistantly spaced locations within the explosive charge 62, so that one detonating signal delivered to the center of the circular explosive charge, will create a "rippling" effect delivering detonating signal to a plurality of locations of the main explosive charge 66, thus causing a substantially simultaneous explosion within the apparatus 50, so that a focused charge is created to sever the tubular member substantially about its circumference as required.

A plurality of spring centralizing means 74 are securedly attached about the periphery of the top compression plate 52, extending upwardly therefrom and to the bottom compression plate 54, extending downwardly therefrom. The spring stabilizing means 74 can be attached for example, by bolts or by welding to the compression plates 52 and 54, the stabilizing means being in the form of C-shaped metal bands curved inwardly, in the direction to the center of the compression plates 52 and 54. The stabilizing means 74 assist in positioning and securing position of the apparatus 50 within a tubular member to be severed.

It is designed that the curved portion of the spring centralizing means 74 contacts the interior of the tubular member to be severed, so that the curved portion is in frictional engagement with the interior of the tubular member, preventing misalignment of the apparatus 50 within the tubular member. The spring centrailizing means 74 can be compressed, moving the metal bands inwardly, when the curved portion of the C-shaped stabilizing means contacts the interior of the tubular member, thus facilitating positioning the apparatus 50 at the designated level.

Figure 8:
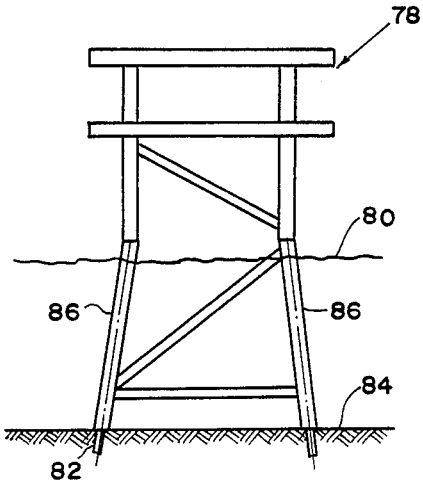
FIG. 8 is a schematic view of an offshore platform showing the water level and mudline into which piles of a platform are embedded.

FIG. 8 schematically illustrates an offshore structure 78, with the water level designated by numeral 80 in the drawing.

As can be seen in the drawing, piles 82 extend below the mudline 84 within the surrounding jackets 86.

Figure 9:
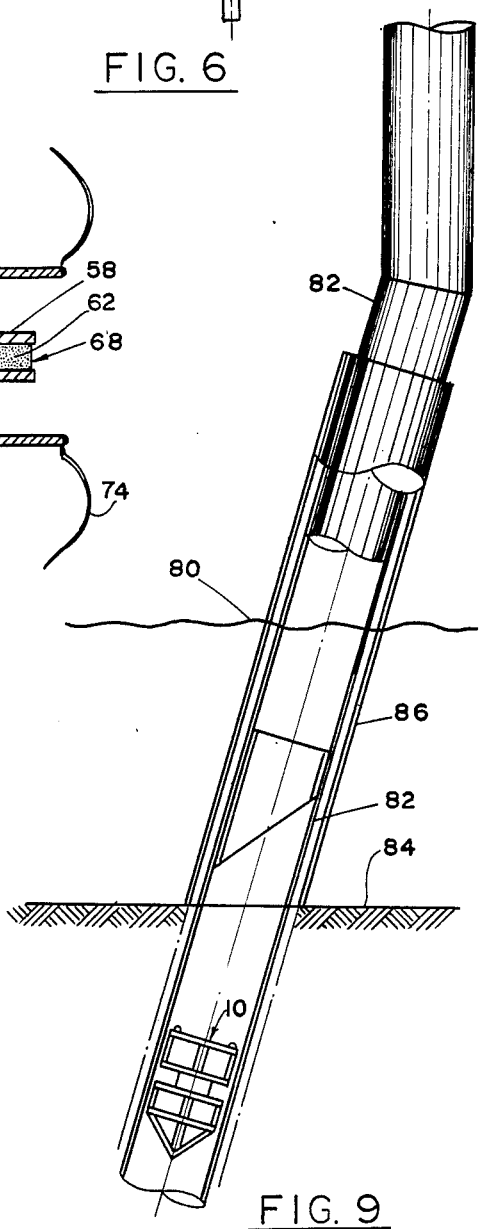
FIG. 9 is a schematic view of an interior of a platform pile, with the apparatus of the present invention lowered to the level, wherein a severing of a tubular member is to take place.

As schematically shown in FIG. 9, an apparatus 10 is lowered into the pile to approximately 20' below the mudline 84, it is designed for the pile to be severed. A detonation signal is sent from the surface in a conventional manner in order to initiate the explosion.

Many modifications and variations of the present invention will be come apparent to those skilled in the art in the light of the above teachings. It is therefore intended that the scope of the present invention be limited only by the scope of the appended claims.

I claim:

1. An apparatus for severing tubular members, comprising:

a frame adapted for positioning inside the tubular member, said frame carrying a circular-shaped explosive charge means with a plurality of circumferentially spaced detonation signal receiving locations, so as to facilitate explosion of the explosive charge means substantially simultaneously about circumference of the explosive charge means, said frame comprising a pair of parallel spaced-apart deflection plate means for creating a focused charge of the explosive charge means positioned between the deflection plate means.

2. The apparatus of claim 1, wherein the frame comprises a ring-shaped sleeve means mounted between said deflection plate means in perpendicular relationship thereto, said sleeve means having a diameter smaller than a diameter of the deflection plate means so that an annular space is formed between exterior of the sleeve means and outer periphery of the deflection plate means for receiving the explosive charge means therein.

3. The apparatus of claim 2, wherein a central conduit means is provided in the frame for housing a detonating means communicating with the explosive charge.

4. The apparatus of claim 3, further comprising an upper and a lower circular compression plate means, each affixed in parallel relationship to its correspondiong deflection plate means, said compression plate means being of a diameter substantially equal to the diameter of said deflection plate means, said compression plate means assisting the deflection plate means in retaining their parallel relationship for creating of the focused charge.

5. The apparatus of claim 1, further comprising means for allowing suspension of the apparatus within the tubular member.

6. The apparatus of claim 1, wherein said frame comprises an upper and a lower circular deflection plate means having complementary mating surfaces forming a substantially circular space therebetween for receiving the explosive charge means.

7. The apparatus of claim 6, further comprising an upper and a lower compression plate means affixed in spaced parallel relationship to the upper and lower deflection plate means, respectively.

8. The apparatus of claim 6, comprising an explosive transfer channel means formed in the annular space receiving the explosive charge means.

9. The apparatus of claim 8, comprising means for delivering detonation signal to the common center of the explosive transfer channel means.

10. The apparatus of claim 7, comprising means for stabilizing position of the apparatus within the tubular member.

11. The apparatus of claim 10, wherein said means for stabilizing comprise a plurality of C-shaped spring centralizers peripherally attached to the upper and lower compression plate means.

12. An apparatus for severing tubular members, comprising:

a frame having an upper and a lower circular deflection plate means affixed in spaced relationship to each other for creating a focused charge of an explosive charge means positioned between the deflection plate means;

an upper and a lower compression plate means fixedly attached to the corresponding upper and lower deflection plate means in spaced parallel relationship thereto;

a ring-shaped sleeve means perpendicularly attached to the upper and lower deflection plates, so that an annular space is formed between exterior of the sleeve means and outside periphery of the deflection plate means, said annular space being adapted for receiving the explosive charge means; and a detonation means for delivering detonation signal from a center of the frame to the explosive charge, so that detonation signal delivered to the explosive charge means facilitates a substantially simultaneous explosion of the explosive charge about an inner periphery thereof.

13. The apparatus of claim 12, further comprising means for positioning the apparatus within the tubular member to be severed.

14. An apparatus for severing tubular members, comprising:

an upper and a lower deflection plate means fixedly attached in parallel relationship to each other, said deflection plate means being provided with complementary mating services and forming a substantially circular space adapted for receiving an explosive charge;

an upper and a lower circular compression plate means, said compression plate means having a diameter slightly greater than a diameter of the deflection plate means, said compression plate means being affixed to the upper and lower deflection plate means in respective parallel relationship;

means for delivering detonation signal to a center of the deflection plate means; and an explosive transfer channel at the center of the deflection plate means for delivering a detonation signal substantially simultaneously to the annularly positioned explosive charge for creating a focused charge of the explosive charge means positioned between the deflection plate means.

15. The apparatus of claim 14, further comprising centralizing means for stabilizing position of the apparatus within the tubular member to be severed.

16. The apparatus of claim 15, wherein said centralizing means comprise a plurality of C-shaped spring members equidistantly fixedly attached to the upper and lower compression plate means about the periphery thereof.

17. The apparatus of claim 16, wherein said explosive transfer channel is divided into a plurality of segments by equidistantly mounted spacer means radiating from a center of the substantially circular space adapted for receiving the explosive charge.

18. The apparatus of claim 1, wherein severing of a tubular member is accomplished in the absence of a jet created by the explosive charge means.

19. The apparatus of claim 1, wherein the focused charge is created in the absence of an air standoff.

* * * * *